United States Patent [19]

Boudreaux

[11] 4,049,332

[45] Sept. 20, 1977

[54] IRONING BOARD CABINET

[76] Inventor: Bettie M. Boudreaux, 839 Claiborne Towers, 119 S. Claiborne Ave., New Orleans, La. 70112

[21] Appl. No.: 640,016

[22] Filed: Dec. 12, 1975

[51] Int. Cl.[2] ..... A47B 77/08; A47B 83/00

[52] U.S. Cl. ..... 312/237; 312/223; 108/33; 108/94

[58] Field of Search ..... 312/237, 223, 282, 324; 108/94, 28, 107

[56] References Cited

U.S. PATENT DOCUMENTS

| | | | |
|---|---|---|---|
| 1,291,484 | 1/1919 | Grosse | 108/94 |
| 1,606,874 | 11/1926 | Gorczynski | 108/94 |
| 1,677,162 | 7/1928 | Adams | 108/33 |
| 2,261,514 | 11/1941 | Dunigan | 108/94 |
| 2,548,437 | 4/1951 | Mantagas | 312/237 |
| 3,055,129 | 9/1962 | Selleck | 108/284 |
| 3,205,032 | 9/1965 | Leigh | 312/223 |

*Primary Examiner*—Paul R. Gilliam
*Assistant Examiner*—Victor N. Sakran
*Attorney, Agent, or Firm*—Pugh & Keaty, Ltd.

[57] ABSTRACT

An ironing board, iron, and light integrally structured with a standard piece of furniture such that said piece of furniture provides a storage space and support platform for efficient storage and efficient operation of said ironing board. The connection between the board and the support platform being a turret connection with integral electrical circuitry which activates said light and said iron upon opening of the doors for movement of the board from said storage position to said operating position.

4 Claims, 4 Drawing Figures

IRONING BOARD CABINET

BACKGROUND OF THE INVENTION

1. Field of the Invention

The instant invention relates to a board used for ironing clothing or other cloth-like material supported in a structure also used as a piece of household furniture. Internal to said support structure is an electrical switching mechanism which activates the iron and the light upon opening the doors of the furniture for movement of the ironing board from a storage position to an operating position, said light being focused upon the subject material to be ironed when said board is in said operating position. This operation is completely accomplished by a one-handed method.

2. Reference to Related Patents

Incorporating a board for ironing clothing and other like material into a piece of furniture is a relatively old operation. An example of a more developed method is illustrated in U.S. Pat. No. 2,210,648 to E. H. Battelle issued Aug. 6, 1940. However, as will be illustrated in the description of the preferred embodiment, the combination of the present invention is not disclosed in the '648 patent.

Additionally, U.S. Pat. No. 2,523,425, to F. B. Gargaglione issued Sept. 26, 1950 is of interest in that it speaks of an ironing board which may form a part of and be completely folded and stored within a cabinet or table or other article of furniture, but does not disclose the combination of the present invention.

Futhermore, U.S. Pat. No. 2,649,137 to J. F. Roberts issued Aug. 18, 1953 discloses a combination of ironing board and bench which also teaches the dual feature of an ironing board in combination with other furniture structure; however, it does not disclose the combination of the present invention.

Of general background interest to the present invention are the following: U.S. Pat. No. 3,022,589 teaches the combination of a washing machine with an ironing board. U.S. Pat. No. 2,518,309 teaches a combination of an ironing board with a laundry and surface wagon. U.S. Pat. No. 2,499,455 teaches a combination of a laundry cabinet and an ironing board. U.S. Pat. No. 2,227,786 teaches a combination of a fold-out table with a cabinet.

As will be seen in the description of the preferred embodiment, the present invention not only provides a structure for storing and supporting an ironing board but provides in combination a switching mechanism which allows for automatically turning on a light and the iron in a one-handed operation not disclosed in previously noted patents.

3. General Description of the Invention

The preferred embodiment of the present invention includes a base to which a board for ironing clothing and other material is attached, an iron and a light focused on the board in its operating position. Additionally, an integral electrical circuitry is provided that will activate the iron and the light when the board is moved from its storage position to its operating position.

Said base for example may be either a buffet or other dining room furniture, a kitchen hutch, a living room or bedroom bookcase, or a bedroom dresser. The board for ironing clothing or other materials is to be located approximately 34 to 36 inches above the floor. The width and length of the board is to be determined by the type of clothing and/or other material to be ironed.

However, in all cases, the board is to be rigid so as to provide a stable base on which to iron the clothing and/or material. The board is to be pivotably attached to the base so that it may be swung out into the operating position easily while still maintaining a sturdy base upon which to iron. Padding over the top and edges of the board is provided. A fluorescent light across the end of the board directly above the pivot point and focused in the direction of the board is provided to supply the right light angle to provide detection of wrinkles in the material to be ironed. Towards the rear end of the board and toward the pivot point, a recessed area is provided and coated with a thin sheet of metal so as to provide a resting place for a hot iron.

Electrical circuitry is supplied to the pivotable turret connecting the board to the base such that when the board is moved from its storage position to its operating position, the electrical circuit activates the light and the iron.

The primary object of the invention is to combine an ironing board with a piece of furniture wherein the ironing board can be moved into operating position one-handedly without the waste of time to connect and direct a light beam at the area to be worked on.

Another object of the invention is to provide a storage place for the ironing board while not in use while still maintaining usefulness of the area in which the ironing board is stored. These and other incidental objects will be apparent in the drawings, specification and claims.

Therefore, a further object of the present invention is to provide a simple, one-handed method for initiating the operation of an ironing board without the waste of time and/or energy.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein:

FIG. 3 is a top view of the base cabinet illustrating the ironing board in a closed position and phantom-lined open position; while

DESCRIPTION OF THE PREFERRED EMBODIMENT

Figure 1:
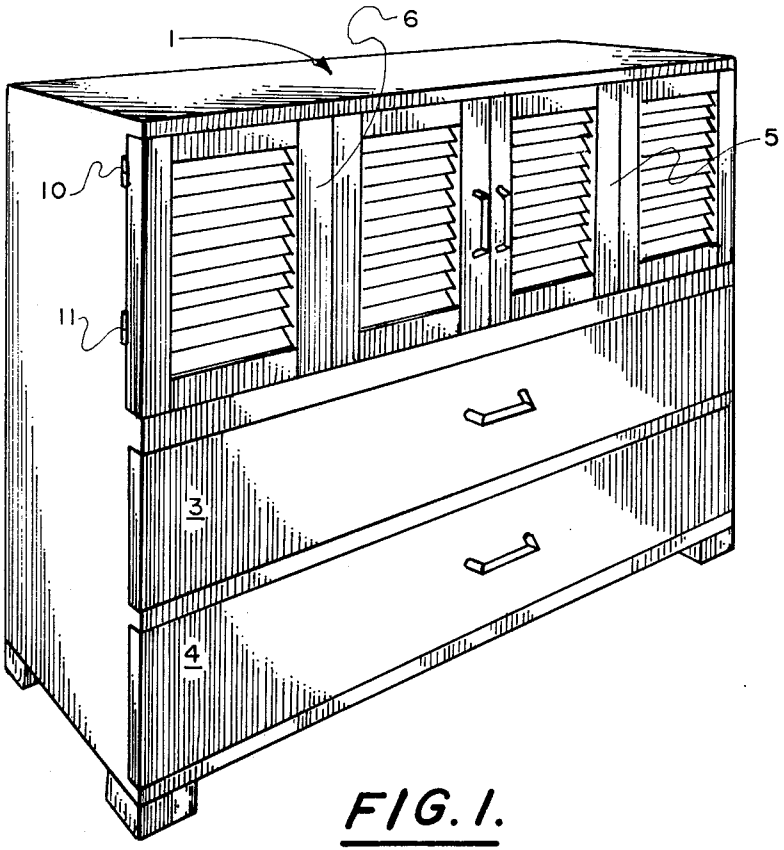
FIG. 1 is an isometric view of the base cabinet in closed position.

The preferred embodiment of the present invention comprises a bedroom dressing cabinet 1 for storage of clothes in lower drawers 3 and 4, respectively. The top portion of the dressing cabinet 1 is equipped with bi-fold doors 5, 6 on the right and left sides of the dressing cabinet 1, respectively. The bi-fold doors 5, 6 are hinged at hinge points 8, 9 and 10, 11, respectively. The bi-fold doors 5, 6 as seen in FIG. 1 when closed form a neat, symmetrical look to the cabinet 1 and form a finished look to the furniture of the room.

Figure 4:
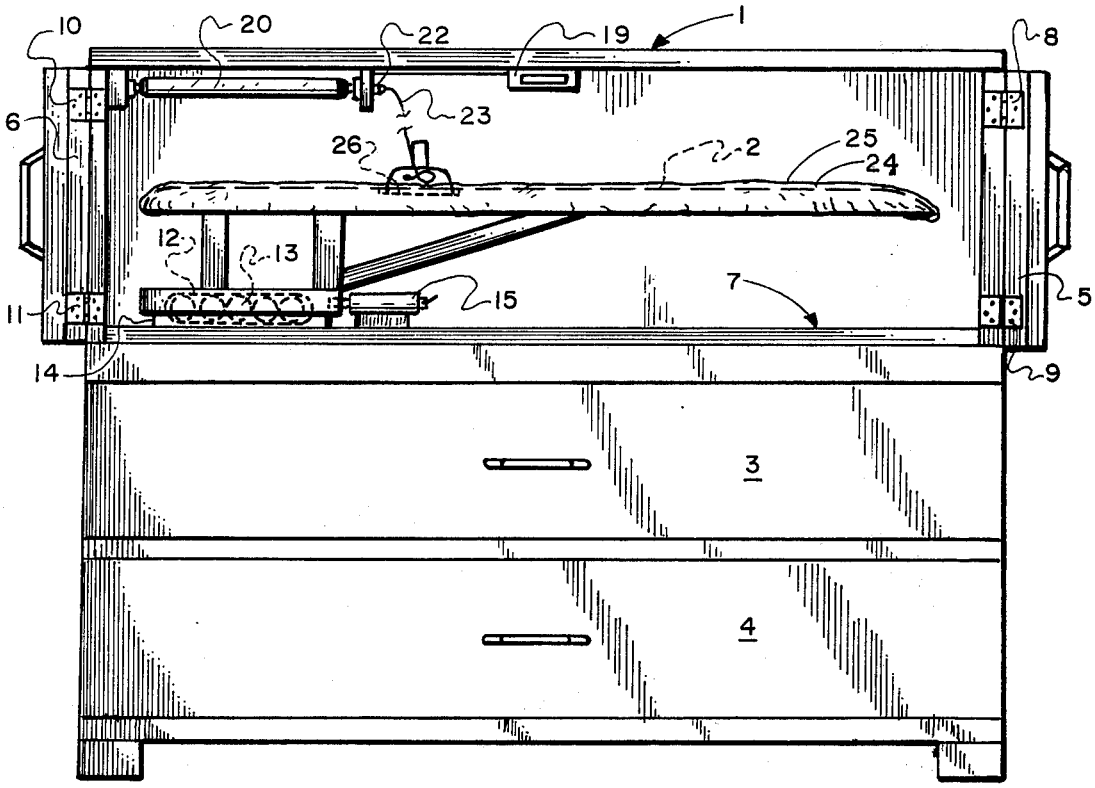
FIG. 4 is a front view of the storage base illustrating the ironing board in the closed, stored position.

Attached to the base 7, inside the bi-fold doors 5, 6, respectively, is an ironing board 2. The ironing board 2 is attached to a base 7 by turret-type bearing similar to a lazy-susan bearing in which a circular channel 12 shown in phantom lines in FIG. 4 is equipped with ball bearings 13 of equal diameter as the channel 12. The top portion of the channel 12 is grooved into the base of the ironing board 2. The bottom is grooved into the plate 14 attached to the top of the base 7.

Such a bearing allows free rotation of the top structure 2 while still maintaining the sturdiness needed in an ironing table.

Figure 3:
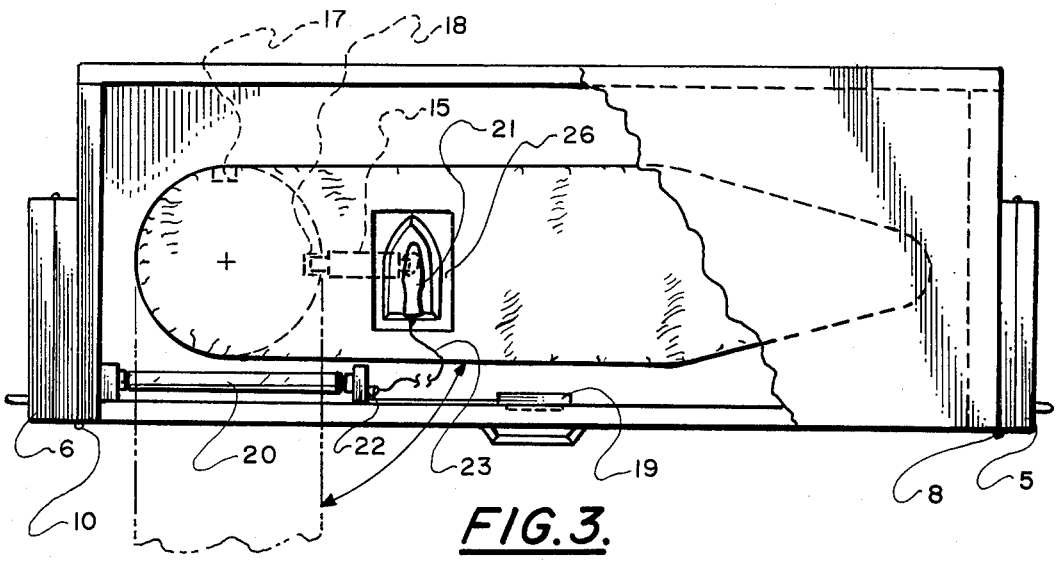

A lock mechanism 15 is provided as shown in FIG. 3 so as to lock the table in the extended or functional position. Also note that notches are provided to lock the table in the stored or closed position. The notches 17, 18 are provided in plate 16 at points 17, 18 so as to allow locking in the stored position as well as in the operating position.

A switch 19 is provided to activate the light 20 and the iron 21 when the base 2 is extended to the operating position. Switch 19 is also deactivated when the ironing board 2 is placed in a stored position as seen in FIG. 3 and 4. A plug-in connection 22 is located adjacent to the light 20 for connection of the iron as seen in FIG. 3. The plug-in connection is switched to the switch 19.

The electrical power supply 23 to the iron 21 is equipped with a coiled wire to allow expansion and contraction without limiting the operation of the iron 21 over the length of the board 2.

Additionally, a heat-resistant portion 26 is mounted on the board 2 to alleviate the need of allowing the iron 21 to cool before closing the cabinet and/or laying the iron 21 flat upon the ironing board 2 surface. It should be noted that the length and width of the board 2 is to be determined by the type of material or clothing to be ironed. Additionally the height of the board from the floor is to be determined by the individual using the board. The board 2 is supplied with a padding 22 and a cover 25. The location of the light 20 is critical to the focus of the light 20 upon the subject to be ironed. It has been found that the location of the light 20 at the extreme right rear end of the board 2 focusing out upon the board 2 is most beneficial to facilitate location of the wrinkles in the material to be ironed. A fluorescent light 20 is used in the preferred embodiment of the present invention; however, other types of lights could be used.

Figure 2:
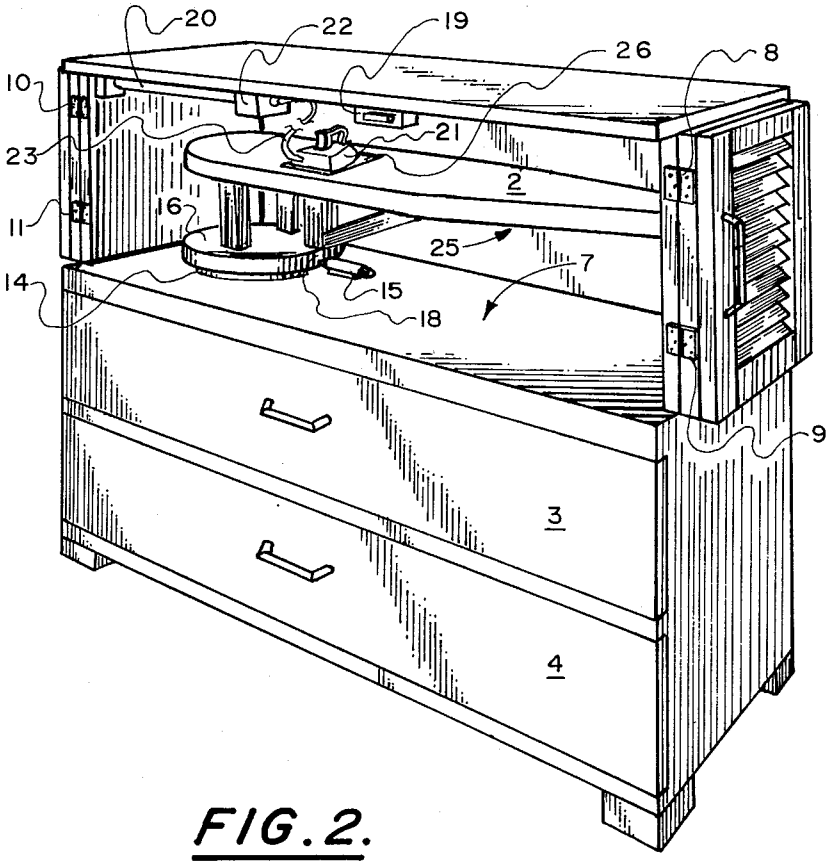
FIG. 2 is an isometric view of the base cabinet illustrating the ironing board and iron in the closed, stored position; but with the doors open

The operation of the present invention is as follows: The bi-fold doors 5, 6 as seen in FIG. 1 are opened and folded back on the extreme left and right ends respectively of the cabinet 1 as seen in FIG. 2. At this point, the switch 19 allows electrical power to flow to the light 20 and the switched plug 22. The light is then energized. Assuming the iron 21 through its electrical power source 23 is plugged into the switched plug 22, the iron also becomes energized and begins to be heated electrically. The next stop of the operation of the present invention is to disengage the locking mechanism 15 from the notch 18 thereby allowing the platform 16 and the attached board 2 to be rotated in a clockwise direction from the stored position as seen in FIG. 2, 3, and 4 to the operational position as illustrated in phantom lines in FIG. 3. At the full extended opepational position, as illustrated in phantom line of FIG. 3, the locking mechanism 15 will engage the notch 17 as shown in FIG. 3. This locking mechanism maintains the board in a sturdy operational position preventing any rotational movement. At this point, the light 20 has been activated and is focused upon the board in an effort to assist in detecting wrinkles in the clothing or other material to be ironed. The iron 21 through its power source 23 is situated on the heat resistant portion 26 of the board 2 and is being heated to the desired ironing temperature. The material to be ironed can be laid upon the outermost end of the board 2 and ironing commenced.

Upon completion of the ironing operation, the iron 21 regardless of its temperature can be replaced on the heat resistant portion 26 of the board 2. The locking mechanism 15 is disengaged from the notch 17 and the platform 16 is rotated in a counter-clockwise direction, thereby moving the board 2 from the operational position to the stored position. Upon reaching the stored position, the locking mechanism 15 will engage the notch 18. At this point the bi-fold doors 5, 6 can be moved from their open position as seen in FIG. 2 to the closed position as seen in FIG. 1. Upon closing the bi-fold doors 5, 6, the switch 19 is deactivated thereby stopping the flow of current to the light 20, the switch 22 and the iron 21.

Because of the many varying and different embodiments that may be made within the scope of the inventive concept herein taught and because many modifications may be made in the embodiment herein detailed in accordance with the descriptive requirements of the law, it is to be understood that the details herein are to be interpreted as illustrative and not in a limiting sense.

What is claimed as invention is:

1. An ironing board cabinet comprising:

a structure defining a horizontally extended, box-like, generally open space located at the front and at the upper level of the cabinet;

door means located along the front of said open space for closing off said open space, said door means comprising doors hinged to open laterally out from the center front of said open space to the side ends of said open space to expose said open space;

a 90° pivot mount located to one side of said open space near one end thereof;

a horizontally 90° swingable ironing board secured by said pivot mount to and near one end of the bottom side of said box-like open space, the length and width of the ironing board being completely containable within said open space when said ironing board is located therein; and electrical circuitry located in the cabinet including an electrical switch, a light, an iron plug outlet, and a source of electrical power, all electrically connected together, said electrical switch being deactivated by being depressed and being located in the front portion of said open space, said door means activating said switch when said door means are moved from the closed position to the open position, said switch being electrically connected to said electrical power source, said light and said iron plug outlet so that when said door means is opened, the switch is activated, thereby activating the light and said iron plug outlet, said light being located at the top and at the front of said open space and focused to place light on the operational area of said ironing board when the door means is opened and the ironing board is pulled out of said open space 90° to its operating position.

2. The ironing board cabinet of claim 1 wherein said light is an elongated fluorescent tube light located with its tubular structure parallel to the front of said open space and is located at the front edge of said open space directly between said pivot mount and the front of said open space and hence over said ironing board when it is pulled out ninety degrees (90°) to its operating position.

3. The ironing board cabinet of claim 1 wherein said door means comprises bi-fold doors hinged to open laterally out from the center from of said open space to the side ends of said open space.

4. The ironing board cabinet of claim 1 wherein said ironing board includes near its pivot mount heat resistant cavity means for receiving and holding a hot iron.

* * * * *